US007189190B2

(12) United States Patent
Lamar et al.

(10) Patent No.: US 7,189,190 B2
(45) Date of Patent: Mar. 13, 2007

(54) GROUP PROGRAM FOR RESISTANCE EXERCISE TRAINING

(75) Inventors: Kevin Lamar, Boulder, CO (US); Teresa Lynn Harvey, Boulder, CO (US)

(73) Assignee: Nautilus, Inc., Vancouver, WA (US)

( * ) Notice: Subject to any disclaimer, the term of this patent is extended or adjusted under 35 U.S.C. 154(b) by 686 days.

(21) Appl. No.: 09/805,067

(22) Filed: Mar. 12, 2001

(65) Prior Publication Data

US 2003/0032524 A1 Feb. 13, 2003

Related U.S. Application Data

(60) Provisional application No. 60/188,381, filed on Mar. 10, 2000, and provisional application No. 60/274,590, filed on Mar. 9, 2001.

(51) Int. Cl.
*A63B 21/00* (2006.01)

(52) U.S. Cl. ..... 482/8; 482/51; 482/57; 482/900

(58) Field of Classification Search ..... 482/1–9, 482/51, 54, 57–65, 900–902
See application file for complete search history.

(56) References Cited

U.S. PATENT DOCUMENTS 3,379,439 A 4/1968 Sorenson et al.
4,363,480 A 12/1982 Fisher et al.
4,478,413 A 10/1984 Siwula (Continued)

FOREIGN PATENT DOCUMENTS

WO WO 94/14505 7/1994

OTHER PUBLICATIONS

*BFit® University Presents Bally "Total Fitness Power/Pump the Official Barbell Workout", Training Manual, 1998.
*Keiser® Power Pacer, Instructor Training Manual©, by Keiser Corporation, 1997, 1998.
*Body Pump™, Trainer Manual Version 11©, Les Mills International/The STEP Company, 1998.
*Body Pump™, Instructor Manual Version 11©, Les Mills International/The STEP Company, 1998.
*The STEP® Company Club Price List, Les Mills International/The Step Company, May 1998.
*Body Pump™, "Become Some Body!", Press Release, Les Mills International/The STEP Company, date unknown.
*Body Pump™, "Aerobic Market 'Pumped Up' about New Zeland's Body Pump™ Program", Press Release, Les Mills International/The STEP Company, date unknown.
*Body Pump Training Brochure, The STEP Company/Les Mills International, date unknown.
*Body Pump™, "Anybody and Everybody Wants to . . . Become Some Body" Brochure, A Product of the STEP Company and Developed by Les Mills Aerobics, date unknown.

(Continued)

*Primary Examiner*—Glenn E. Richman
(74) *Attorney, Agent, or Firm*—Dorsey & Whitney LLP

(57) ABSTRACT

A group program for resistance exercise training is disclosed. The group program for resistance exercise training includes the steps of: providing a plurality of convertible multi-position exercise units; providing instruction and operating the plurality of exercise units for performing a first exercise in a first configuration; providing instruction in converting the plurality of exercise units from the first configuration to a second configuration; and providing instruction in operating the plurality of exercise units in the second configuration. The exercise units include a frame, a seat positioned on the frame and an adjustable resistance engine attached to the frame.

35 Claims, 4 Drawing Sheets

U.S. PATENT DOCUMENTS

| | | | | | |
|---|---|---|---|---|---|
| 4,511,137 | A | | 4/1985 | Jones | |
| 4,765,613 | A | | 8/1988 | Voris | |
| 4,863,161 | A | | 9/1989 | Telle | |
| 4,944,511 | A | | 7/1990 | Francis | |
| 5,020,794 | A | | 6/1991 | Englehardt et al. | |
| 5,037,089 | A | | 8/1991 | Spagnuolo et al. | |
| 5,062,632 | A | | 11/1991 | Dalebout et al. | |
| 5,089,960 | A | | 2/1992 | Sweeney, Jr. | |
| 5,209,461 | A | | 5/1993 | Whightsil, Sr. | |
| 5,236,406 | A | | 8/1993 | Webber | |
| 5,265,589 | A | | 11/1993 | Wang | |
| 5,277,681 | A | | 1/1994 | Holt | |
| 5,299,992 | A | * | 4/1994 | Wilkinson | 482/54 |
| 5,366,426 | A | | 11/1994 | Glavin | |
| 5,495,799 | A | * | 3/1996 | Daniel | 482/8 |
| 5,616,110 | A | | 4/1997 | Nascimento | |
| 5,655,997 | A | | 8/1997 | Greenberg et al. | |
| 5,674,167 | A | | 10/1997 | Piaget et al. | |
| 5,888,179 | A | | 3/1999 | Singhal | |
| 5,906,566 | A | | 5/1999 | Whitcomb | |
| 5,921,897 | A | | 7/1999 | Stevens | |
| 6,117,055 | A | | 9/2000 | Boland | |
| 6,447,430 | B1 | | 9/2002 | Webb et al. | |
| 6,605,022 | B2 | | 8/2003 | Webber | |
| 2002/0077230 | A1 | | 6/2002 | Lull et al. | |

OTHER PUBLICATIONS

New Fitness Trend Guarantees Company's Success, Press Release, The STEP® Company, date unknown.

The Step, "The Original Health Club Step", brochure, The Step Company, 1995.

The Step® Home Workout System, The Compact Professional Step Trainer, brochure, The Step Company, 1995.

The Step® Home Trainer, "The Intermediate Home Step System", brochure, The Step Company, 1995.

The Body Bar, "A Total Body Conditioning Bar", brochure, The Step Company, 1995.

The Slide Home Trainer, "The Professional Protable Home Slide", brochure, The Step Company, 1995.

The Slide Trainer The Professional Slideboard, "The Professional Slideboard", brochure, The Step Company, 1995.

The Step, "The Professional Club Model", brochure, The Step Company, 1995.

The Studio Step, "The Compact Club Model", brochure, The Step Company, 1995.

"Taking a Good Idea One STEP Further", Press Release, The Step Company/Les Mills International, date unknown.

Cybex World, Jul. 2000, vol. 10, Issue 2, "New Products Prove Passion for Human Performance".

Johnny G Spinning© Instructor Manual, Copyright 1996.

"The Standing Firm System", located at http://www.standing–pilates.com, 6 pages (retrived Sep. 29, 2004).

* cited by examiner

GROUP PROGRAM FOR RESISTANCE EXERCISE TRAINING

CROSS-REFERENCE TO RELATED APPLICATIONS

This application claims the benefit of U.S. Provisional Application No. 60/188,381 entitled "Variable Load Multi-Position Bench Exercise Unit and Associated Group Exercise Program" and filed Mar. 10, 2000, by Andrew P. Lull et al., and U.S. Provisional Application No. 60/274,590 entitled "Group Program for Resistance Exercise Training" and filed Mar. 9, 2001, by Kevin Lamar et al., (the "Provisional Applications"). The Provisional Applications are incorporated herein by reference including all publications and issued patents cited therein.

BACKGROUND OF THE INVENTION

1. Field of the Invention

The field of the invention relates generally to group exercise programs. More particularly, the invention relates to group programs for resistance exercise training.

2. Description of Related Art

Resistance training, also commonly referred to as strength training or weight training, introduces progressive resistance to an exercising body. Resistance training is most often performed individually or in small groups using equipment ranging from free weights to sophisticated pieces of machinery. Such training often intimidates exercisers, requires exercisers to coordinate their schedule with others (e.g. spotters, workout partners and personal trainers), and fails to provide sufficient motivation to keep exercisers training on a regular basis.

Groups have attempted to build on the group dynamic that has been successfully used in cardiovascular training programs such as aerobic and Spinning® training by designing free weight group resistance training programs using barbells, weights and collars. In these group free weight training programs, participants perform resistance training exercises to choreographed music in a group setting. In order to maintain a safe environment, however, each participant should have a spotter assigned to them during each exercise. This requires that either participants stop their workout to spot each other or that the group include enough instructors to spot each member of the group. The first option is inefficient, decreases the intensity of the workout, and requires longer group sessions in order to perform the same exercises. The second option, however, is likely cost-prohibitive in that the organizer of the group program would have to provide an instructor for each member of the group.

SUMMARY OF THE INVENTION

The present invention provides a group program for resistance exercise training including the steps of: providing a plurality of convertible multi-position exercise units; providing instruction and operating the plurality of exercise units for performing a first exercise in a first configuration; providing instruction in converting the plurality of exercise units from the first configuration to a second configuration; and providing instruction in operating the plurality of exercise units in the second configuration. The exercise units include a frame, a seat positioned on the frame and an adjustable resistance engine attached to the frame.

The present invention further provides a method for implementing the group program including the steps of: providing training for the group program for one or more representatives each having an area of responsibility; providing training for a plurality of individual instructors for the planning and administering individual sessions of the group program via the representatives; certifying the plurality of individual instructors have successfully completed the training; and planning and implementing a group resistance training program using a plurality of convertible multi-position exercise units. Each of the exercise units is convertible to several different configurations to allow a user to perform multiple different exercises on the exercise units. The exercise units include a frame, a seat positioned on the frame and an adjustable resistance engine attached to the frame.

BRIEF DESCRIPTION OF THE DRAWINGS

The preferred embodiments of the invention will be decided in detail with reference to the following figures, wherein like numerals refer to like elements, and wherein.

DETAILED DESCRIPTION OF THE INVENTION

Figure 2:
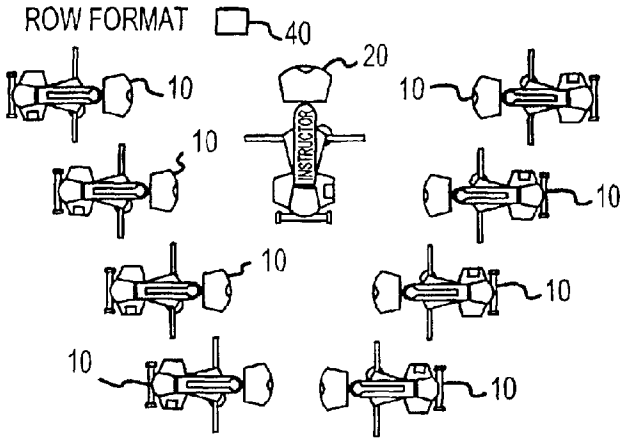
FIG. 2 is top view of another classroom arrangement that may be used in a program of the present invention.

The present invention provides a group program for resistance exercise training. The program helps eliminate common excuses for not participating in resistance training and provides an effective, safe and enjoyable training program along with a "coach" to lead participants every step of the way. The group aspect of the program can both take the boredom out of resistance training by applying it in a group setting and take the guesswork out of individuals having to prepare safe and effective workouts for themselves. An instructor can act as a participant's personal trainer while in a group setting by providing one-on-one attention. The instructor can prepare resistance-training classes that may be customized based on the goals of the participants.

The program includes one or more individual classes. The classes can excite participants with varying exercises, intensity and formats and can challenge participants to surpass plateaus in their resistance training efforts. The classes are preferably organized to seem effortless and straightforward to the participants. The participant should be able to fully engage in each class. Each class can have a specific focus and a list of goals that is prepared in advance with particular participants in mind.

Resistance training is commonly referred to as strength training or weight training. For the purposes of this application, the term "resistance training" refers to a system of physical conditioning introducing progressive resistance to an exercising body. Resistance may be provided via one's own body weight, the use of additional weights (hand held or otherwise), gravity resistance (terrain inclination or vertical plyometric forms of training), environmental resistance (water, air), elastic tubing or resistance training machines.

"Progressive resistance" as used in this application refers to increasing resistance applied in a particular exercise over a series of workouts. While it is not required that each workout include an increase in resistance for a particular exercise over the previous workout, over the course of an exercise program, the resistance applied during a particular exercise is systematically increased and/or progressively more difficult exercises are performed as the participant becomes stronger at least until a target resistance level or exercise difficulty level has been met.

Resistance training can be used for both physical rehabilitation and for athletic and general conditioning. In most instances, resistance training is used to promote general physical fitness and conditioning. The type and number of exercises may vary with the participant's objectives, age, sex, weight and experience level. Generally speaking, in the absences of intervention, the human body becomes less flexible, less muscular and weaker with age. Systematically exposing human skeletal muscle to routine bouts of resistance training with appropriate loads can create increased strength, power and muscular endurance and can help fight the aging process. Maintaining muscle mass can greatly assist with everyday tasks such as carrying loads, performing tasks or remaining injury-free during recreational pursuits.

A resistance training program should be safe, effective and efficient. Exercises with a high risk for injury are preferably avoided. Resistance training should be performed in a slow and controlled manner. Fast weight lifting movements performed in succession, for example, may place excessive stress on the muscles, tendons and joints. Further, different resistance training routines will produce different results. Depending upon a participant's goals, the program may be designed to produce a desired effect such as by altering the selected exercises, the sequencing of the exercises, and the numbers of sets and repetitions. Seeing results from a resistance training program depends upon the development of a sound program. The time and energy efficiency of a particular resistance training program can also be optimized by selecting specific exercises, numbers of sets and repetitions, intensities, progressions, speeds, ranges, frequencies and performances.

A resistance training program can cause many physiological changes in a body such as increased muscle fiber size, muscle contractile size, tendon strength, bone strength and ligament strength. These changes may increase a participant's physical capacity and ability to perform work or exercise. The increased muscle size and function developed from resistance training can lead to both muscular strength and endurance. Previously difficult tasks can be accomplished with considerably less effort. Resistance training can also increase the participant's metabolic rate. Resistance training, by nature, is a calorie burning activity. The heart rate increases, as does the blood pressure and energy metabolism. The resting metabolic rate is also influenced because muscle tissue is added from resistance training, raising the amount of energy that is required to sustain the muscle. Further, resistance training can increase the participant's athletic power. Power is a combination of movement speed and movement force. Movement force depends upon the muscles of the human body, which can be greatly improved through resistance training. A resistance-training program can also lower a participant's risk of injury. A strong muscular system offers protection against impact injury, and having a balanced musco-skeletal system can prevent over-use injuries. Resistance training further enhances a participant's physical appearance by stimulating muscle fibers to increase a muscle's size and strength. The increase in size and strength leads to enhanced muscle tone and firmness.

Muscle Function

When a muscle is activated, it attempts to shorten by trying to pull its attachments closer together. Depending upon the force output, a muscle can react in three different ways: it can shorten, lengthen or remain the same. A "positive contraction" for the purposes of this application refers to muscle shortening. A positive contraction usually occurs when a muscle creates enough force to lift a load. A "negative contraction" refers to the lengthening phase of a muscle's activation and occurs when a muscle is overcome by resistance. Negative contractions can be used to reduce the force of gravity and to exert a slow, controlled movement. A "static contraction" indicates that the muscle neither contracts nor lengthens, but remains activated a fixed joint angle, i.e., the muscle's force is equivalent to its load. This may occur by design, such as in isometric exercises, or immediately prior to a failure of a positive contraction. A static contraction may result in increased strength at the angle trained, but does not reflect increased strength throughout the joint's full range of motion.

A muscle can be asked to move in several different ways whether it be the focus of a specific movement, an assister in a movement or an opposition to a movement. A "prime mover" or "target" muscle refers to a muscle that is responsible for controlling a movement. The muscle contracts positively when lifting the weight. A particular exercise can have more than one prime mover or target muscle. The biceps muscle group, for example, is the prime mover muscle group for performing a bicep curl exercise.

An "antagonist muscle" refers to a muscle that is responsible for producing the opposite movement of the prime mover. The antagonist muscle helps ensure smooth joint movement. As the prime mover contracts and shortens to create a movement, the antagonist muscle relaxes and lengthens. The triceps muscle group, for example, is an antagonist muscle group for performing a bicep curl exercise.

A "synergist" or "assister" muscle refers to a muscle that assists one or more other muscles to accomplish a movement, but is not solely responsible for the movement. The triceps muscle group, for example, is a synergist muscle group for a bench press exercise.

A "stabilizer muscle" refers to a muscle that contracts with no significant movement for a particular exercise, but that functions to hold other joints stable while the desired movement is occurring in another joint. The erector spinea muscle, for example, functions as a stabilizer muscle during a squat exercise.

A "dynamic stabilizer muscle" refers to a biarticulate muscle, i.e., a muscle that crosses two joints, that simultaneously shortens at the target joint and lengthens at an adjacent joint with no appreciable difference in length. The responsibility of a dynamic stabilizer is similar to the responsibility of a stabilizer muscle, i.e., hold a joint stable while a desired movement can occur in another joint. The hamstrings and the gastrocnemius, for example, both act as a dynamic stabilizer muscles in a squat exercise that targets the quadriceps muscle group.

An "antagonist stabilizer muscle" refers to a muscle that contracts to maintain the tension potential of a biarticulate muscle at another joint. The antagonist stabilizer muscle may be contracted throughout the exercise or may be contracted only at one extreme of the movement. The rectus abdominis and the obliques muscles, for example, function as antagonist stabilizer muscles in a squat exercise.

Resistance Training Guidelines

Creating a resistance training routine includes selections of particular exercises, durations, intensities, progressions, speeds, ranges and frequencies. A particular resistance training workout may include exercises that target all or a portion of the major muscle groups of the human body. These major muscle groups include: the quadriceps, the hamstrings, the lower back, the abdominals, the chest, the upper back, the shoulders, the biceps, the triceps, and the neck flexors/extensors. Particular exercises, for example, may be selected to create a full-body resistance-training workout i.e., each of the major muscle groups of the human body are targeted.

The duration, i.e., the number of sets and repetitions, for each particular exercise can be selected depending upon the goals of the participants in the group. In some instances, one set of strength exercises, is sufficient to achieve strength gains. The number of repetitions for each set should be between about 8 and about 12 if the training goal of the participants is to focus on a combination of strength and endurance. The number of repetitions, however, should be less for more of a strength focus and greater for more of an endurance focus.

The intensity of the training will also vary with the desired training goals. For example, in a program designed to focus on a combination of strength and endurance, muscle fatigue, i.e., where the muscle is no longer able to contract positively, for each participant should normally occur between about 8 and about 12 repetitions for a particular exercise.

The progression in the amount of resistance that is used in a particular exercise for a participant also depends upon the training goals of the participant. Generally, the resistance should be increased when the participant can complete the number of repetitions and/or sets desired for the participant's particular training goals without experiencing muscle fatigue. When the amount of resistance is to be increased, gradual increases in the amount of resistance are generally preferred. For example, an increase of about 5% is recommended.

The speed of the resistance training is also a consideration in designing a resistance training routine. Lifting in a slow and controlled manner is more difficult, but is preferred. For example, a speed of about two seconds for each lifting movement and an equal time for a descent is desired. Fast lifting and descents are not recommended because of the stress they place on muscles and joints.

A resistance training routine should also take the range of motion for each exercise into consideration. Generally, exercises should be performed throughout a full range of motion except in certain cases such as during rehabilitation of an injury where performing limited range of motion exercises may be preferred.

The frequency of the workouts can also be selected depending upon the goals of the participants. Generally, at least two resistance-training workouts for each targeted muscle group per week is recommended. Training a particular muscle group two days in a row, however, is generally discouraged because muscles require about 48 hours to recover.

Attention to proper breathing patterns is also recommended. Participants should not hold their breath during resistance training exercises. Rather, participants should exhale during lifting movements and inhale during lowering movements.

Development of Muscular Strength, Power and Endurance

Particular resistance training routines may be designed to focus on muscular strength, power and endurance independently or to focus on two or more of these attributes collectively. "Muscular strength" refers to the maximal amount of force generated by a muscle or muscle group in various directions at various velocities. Utilizing maximal loads and a minimal number of repetitions, e.g., from about 1 to about 6, develops strength. True strength training implies that the participant is seeking additional strength. Thus, a strength training participant generally uses heavy resistance and performs a minimal number of repetitions before muscle fatigue occurs.

"Muscular power" refers to the rate at which work is performed. Variables include resistance distance and time. Power consists of strength and speed, both of which can be improved with training. Maximal power may be developed by utilizing either (1) moderate to heavy loads in explosive movements, e.g., power clean, performed at a low number of repetitions such as from about 1 to about 6 repetitions, or (2) light to moderate loads performed at a higher number of repetitions, e.g., from about 12 to about 15 repetitions, in sport-specific movements. Resistance training for muscular power is often used to improve athletic performance, injury prevention and rehabilitation from injury.

"Muscular endurance" refers to the ability of a muscle or a group of muscles to continue to function over time. Muscular endurance is most specifically obtained via endurance activities. Resistance training to focus on muscular endurance generally includes using light loads at a relatively higher number of repetitions than for specific training for muscular strength and muscular power. For example, a muscular endurance resistance-training program may include using loads light enough to permit the participant to perform at least about 15 repetitions before muscle fatigue occurs.

Natural Movement Training

The most natural human movements are multiple-joint movements that are dynamic, isolateral and used to naturally rotate the extremities. These movements also utilize active dynamic stabilization of the joints, and the trunk is called upon to protect the spine with all of its passive structures. Natural movements also provide a sound balance between the prime mover muscles and the stabilizing muscles. "Natural Movement Training" makes use of these closed-chain muscle actions. It develops neuromuscular coordination, produces little or no shear forces and protects joints with the pre-activation of the joint stabilizing muscles. Instead of training particular muscle groups, such as the biceps, triceps, chest, back and legs, independently, a participant can train his or her body as a whole. In Natural Movement Training, each body part is encouraged to achieve the proposed exercise. The exercises used in Natural Movement Training can focus on muscle control and on developing torso strength and stability. Emphasis can be placed on the abdominal, lower back extensor, and pelvic muscle groups, for example. While working through a full range of motion, the participant can train new neural pathways in his or her body. The stabilizer and assister muscles also play a significant role. Natural Movement Training can make the body more proficient at every day tasks and activities as well as at highly sophisticated movement. Increased strength, flexibility, coordination and balance are all by-products of Natural Movement Training. It teaches muscles to work in the most efficient and bio-mechanically correct way.

Natural Movement Training can increase the participant's ability in every day activities; anything that requires bending, lifting and twisting. By training the core muscles in this way, the stabilizing muscles learn to automatically fire and tighten when possible, thus protecting the human body in daily life. Natural Movement Training can also increase a participant's efficiency in multi-joint movements, dynamic body movement, active stabilization of the torso, balance between the prime mover muscles and the stabilizing muscles, rotating joint motion, neuromuscular joint protection, and improved overall coordination.

Although there are hundreds of movements that occur naturally in every human being that may be incorporated into a Natural Movement Training program, five of the most common naturally occurring movements are preferably incorporated into a Natural Movement Training program. These five include: the pull, the pull down, the push, the push up and the body extension. The "pull" movement refers to moving an arm that is extending in front of the body toward the body such as to bring an object closer to the body. The "pull down" movement refers to moving an arm that is extended above the head and body toward the body in a downward movement such as to bring an object closer to the body. The "push" movement refers to extending an arm away from the body such as to move an object from close in to the body to a position farther away. The "push up" movement refers to extending an arm above the head and body and moving the arm away from the body in an upward motion such as to push an object further away from the body. The "body extension" movement refers to moving the entire body from a tighter position, such as a seated or squat position, to an upright and extended (open) body position.

Each of these movements has the following characteristics that constitute a Natural Movement Training exercise:

- They are multiple joint movements, i.e., more than one joint is moving to perform the proposed exercise.
- They are closed-chain movements, i.e., several muscles and groups of muscles work together with the end of the exercising limb supporting the weight.
- The closed chain movements trigger neuromuscular reflexes to protect the joints and the spine.
- When such movements are done using one of the arms in isolation such as during a right arm isolation bicep curl, dynamic movement and dynamic stabilization is needed to occur in the spine i.e., when muscles along the spine simultaneously shorten at the target joint and lengthen at the adjacent joint with no appreciable changes in length.
- The movements done with the arms make natural pronations, when the arms are flexed, and supinations, when the arms are extended, of the forearms, i.e., it is necessary for the forearms to rotate.
- The movements tend to reduce shear forces in the joints by keeping the load or resistance as close to the body as possible and by bringing the extended arm to the center of the body, i.e., naturally converging movements.

Natural Movement Training can deliver well-rounded and functional programming to strengthen muscles and increase muscular endurance, while simultaneously improving a body's natural movement capacity. Classes can be designed to integrate natural strength moves with traditional strength and endurance exercises. Participants that perform natural strength moves class after class can train their bodies to protect themselves. Switching on the muscles necessary to protect the spine and other delicate areas can become second nature and can protect the participants from unnecessary injuries in the course of day-to-day activities.

Instruction

The program of the present invention includes the leadership of an instructor. While the use of a live instructor is preferred, the program may also have video and/or audio-recorded instruction, computer-generated instruction or even virtual reality instruction. The instruction may be performed live, played at the exercise location, broadcast such as over wired or wireless technology, transmitted over a network such as the Internet or an intranet or the like. Although the instruction should lead the participants through the program such as by introducing the particular exercises, demonstrating the proper form of the exercises and keeping the program moving, the instructor also preferably acts as a coach to the participants. The coaching role can be used to motivate each participant, monitor each participant, offer insurances and promote success, encourage change and progression, keep up the energy intensity of the class, reinforce and praise good work, create a team approach to strength results, offer one-on-one attention within the group environment, etc.

Preparation such as logistical preparation, physical preparation and mental preparation should also be made before the class begins. Logistical preparation, for example, can include music selection, apparel and footwear, classroom set-up, class format and exercise sequencing. Music selection can include background music or choreographed music to which one or more of the exercises may be performed. Depending upon the particular participants and exercises, music can be selected with the individual participants taste and preferences in mind. For some participants, listening to the beat of the music can be a strong determinant in the guiding movement. For others, however, following music may be associated with dance formats or other aerobic formats, which many people try to avoid. For these participants, it may be more productive to select background music to enhance the atmosphere of the class rather than as a foundation of the class. Also, in order to attract diverse groups of participants, a diverse selection of music may be desired.

Figure 1:
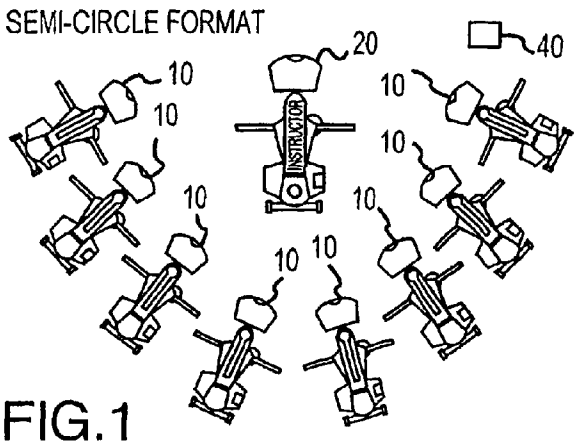
FIG. 1 is top view of an exemplary classroom arrangement that may be used in a program of the present invention.
Figure 3:
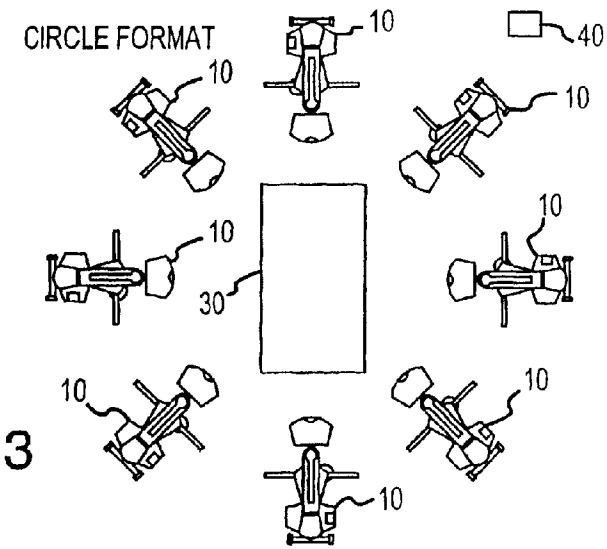
FIG. 3 is top view of yet another classroom arrangement that may be used in a program of the present invention.

The classroom set-up can be an integral part of the program. Because the various exercises and equipment used in the class will be new to many of the participants and because correct physical execution of the exercises can be important, it is preferable to arrange the classroom in such a way that the instructor is clearly visible to the participants. FIGS. 1–3, for example, show three preferred arrangements of resistance training exercise units in which the participants' resistance training exercise units 10 are arranged so that the participants can clearly see the instructor during the exercises.

In FIG. 1, for example, eight of the participants' resistance training exercise units are arranged in a semi-circle around the optional resistance training exercise unit 20. The participants' exercise units 10 are positioned to focus on a central area at which an optional instructor exercise unit 20 is positioned. A stereo or other such music playing device 40 can be positioned off to the side for easy access by the instructor yet is out of the way of the students. In this configuration, each participant has sufficient space around their particular exercise unit to perform their required exercises, yet they are all central enough so that the instructor can access each participant and give individual tips on technique, as well as motivation on an individual basis. The close association with the other participants in the class also maintains the group dynamic affiliated with exercising with a number of other people. In this way, each participant can be given sufficient individual attention in order to help them perform the exercises properly and in a safe manner and to maximize personal results.

In FIGS. 2 and 3, the participants' exercise units 10 are arranged in a row format and a generally circular or oval format, respectively. Again, the participants' exercise units are positioned to focus on a central area at which an optional instructor exercise unit 20 (FIG. 2) or an instructor 30 (FIG. 3) is positioned. Other formats in which the participants can clearly see the instructor can also be used within the scope of the present invention.

In some instances, such as shown in FIG. 3, it may be preferable that the instructor 30 not have an instructor resistance training unit 20 so that the instructor 30 is more readily able to concentrate on training and motivating the participants since he or she is not exercising along with the participants. Alternatively, the instructor 30 may have the optional instructor resistance training unit 20 such as shown in FIGS. 1 and 2. In these embodiments, the instructor may demonstrate the operation of the instructor exercise unit 20 and one or more of the exercises on the instructor exercise unit 20 and then walk around the exercise unit 20 to train and motivate the participants, or the instructor may exercise along with the participants.

The class size is preferably kept between about four and about twelve participants in order to maintain a group dynamic while still allowing the instructor to spend sufficient individual time with each class participant.

The class format and exercise sequencing is also an important aspect of the preparation for the group program. Due to the nature of the program, resistance training concepts and clearly defined goals are preferably designed to extend over a specified period of time. A program plan for a class that meets once per week, for example, should preferably extend for at least about a one month period. Each class should have a focus or goal that will be a factor in the exercise selection and class progression. One example of a plan for a beginner resistance training program is shown in Table 1 below.

TABLE 1

BEGINNER CLASS - WEDNESDAYS

| Class Number | Types of Moves Included (#) | Focus |
|---|---|---|
| Week #1 | All basic moves (8 exercises) | Perfect Technique |
| Week #2 | All basic moves (10 exercises) | Resistance Increase |
| Week #4 | Basic moves + 2 Intermediate Moves (10 exercises) | Intermediate Technique |
| Week #6 | Basic moves + 4 Intermediate Moves (12 exercises) | Resistance Increase for Basic Moves |

Outlining goals for every class can be used to provide a "road map" for the participants. Such a plan can validate many participants' choice to resistance train in a group setting, make participants feel more accountable, encourage their participation from class to class, and provide a sense of accomplishment when goals are met and surpassed.

Exercise Unit

Many types of exercise units may be used in the program of the present invention. The exercise units used in the program of the present invention are convertible to several different configurations so that the participants can perform many different exercises on this one piece of equipment. The exercise units are also preferably durable so that they will survive repeated usage in a health club atmosphere.

Figure 4:
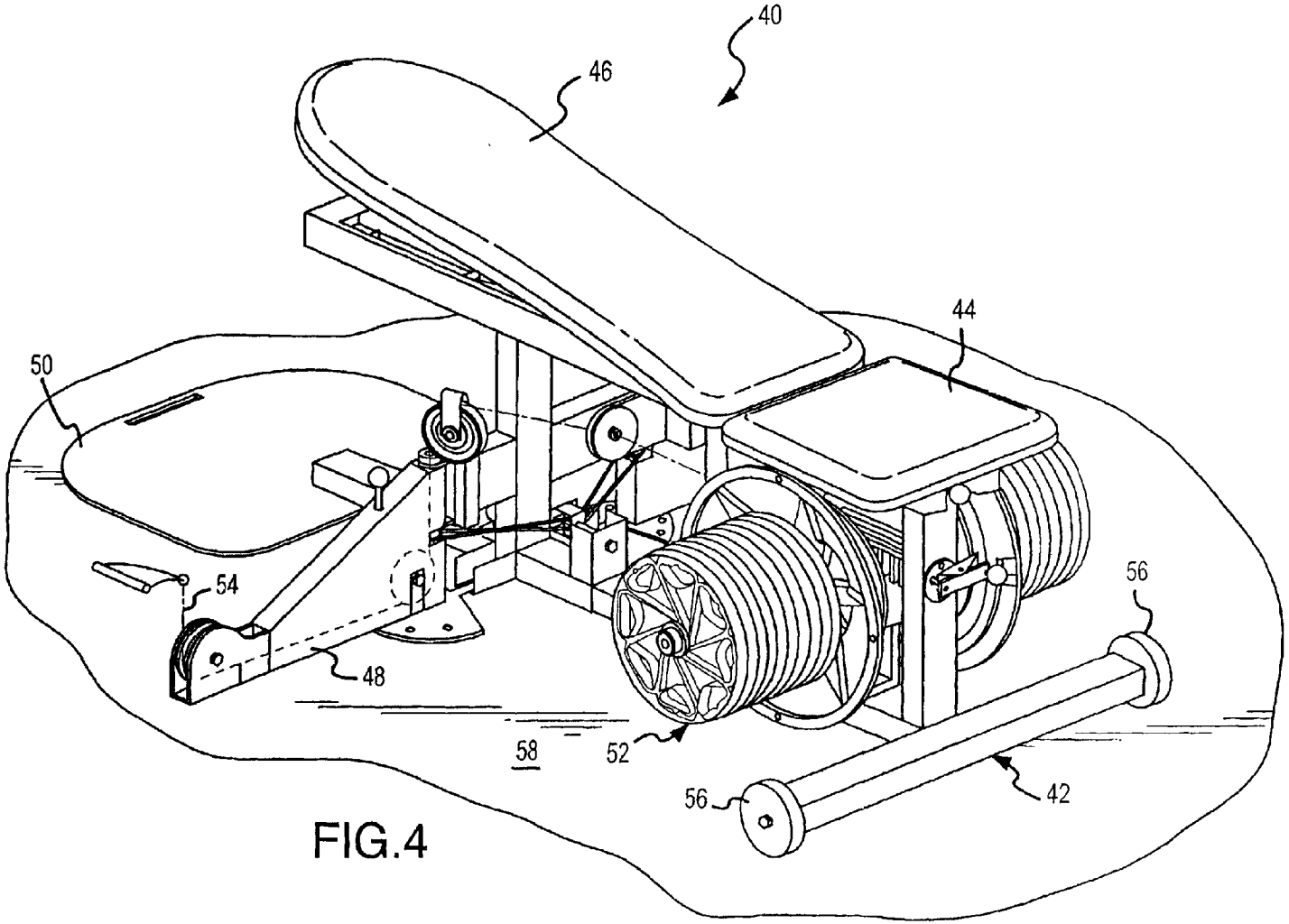
FIG. 4 shows one embodiment of an exercise unit that may be used in a program of the present invention.

In one embodiment, for example, the exercise unit used in the program of the present invention may be an adjustable-load multi-position bench unit 40 such as shown in FIG. 4. The bench unit 40 includes a frame structure, an adjustable seat bottom 44 and seat back 46 structure, variable position arm structures 48, a standing support platform 50, and a load or resistance engine 52. The cable 54 used in the system is shown in dash. The bench unit 40 is convertible to several different configurations to allow a user to perform many different exercises on this one piece of equipment. The bench unit 40 is also easily portable to allow it to be moved by the user from one location to another, such as from an active exercise area to a storage area.

The seat bottom 44 and seat back 46 structure, resistance engine, adjustable arm structure 48, and standing support platform 50 are all attached to the frame 42. The bench unit has rollers 56 at one end of the frame structure 42 to allow the bench unit to be rolled by the user to the desired position. The bench unit can also be stood on end, the same end at which the rollers are attached, to allow for efficient vertical storage of the bench. Storing the bench in a vertical orientation minimizes the floor space taken up by the bench when stored.

The seat bottom 44 and seat back 46 structure are attached to the frame 42 in a manner that allows them to be adjusted with respect to the frame. The seat bottom 44 can be adjusted from a horizontal position to an inclined position. The seat back 46 can also be adjusted from a horizontal position to an inclined position. The adjustable arms 48 can be moved to several positions in horizontal arcs along the support surface 58, from parallel to the bench unit 40 and extending toward the standing platform 50 to parallel to the bench unit and extending toward the seat.

The resistance engine 52 is attached to the frame 42 and is positioned generally below the seat bottom 44. The resistance engine extends laterally to both sides of the frame, and does not interfere with the movement of the adjustable arms 48 or the user. The resistance engine is easily adjustable to various desired constant load levels, thereby replicating a free-weight effect, and eliminates the need for adding or removing more traditional weight plates or stack plates. In addition, the resistance engine weighs much less than the load it can create for the user.

The standing support plate 50 rests on the support surface 58 and is adjustable with respect to the frame 42. The user can stand on the support plate for various exercises (typically when the arms 48 are extending parallel to the bench and toward the support plate). This helps anchor the bench 40 to the support surface during these exercises, and provides a stable and consistent area for the user to stand during these exercises.

The bench unit 40 is relatively small and is convertible to allow several different exercises, and includes an easily adjustable resistance engine 52 compactly positioned beneath the bench and out of the user's way. The bench unit 40 is further described in co-pending U.S. application Ser. No. 09/802,835 entitled "ADJUSTABLE-LOAD UNITARY MULTI-POSITION BENCH EXERCISE UNIT" filed by Lull, et al. on Mar. 8, 2001, which is incorporated herein by reference.

The wide variety of exercises that can be performed on the bench units 40 allows for each class to be tailored for its particular level, and varied throughout time as the class progresses to different levels of fitness training. The variety of exercises that can be performed also allows the instructor to customize the class to the participants' liking or the class needs, and does not rigidly require the instructor to perform only certain types of exercises due to the limited scope of the equipment. This variety of exercises is made possible with the bench unit 40, with its resistance engine that is able to provide a selective variable level of a load, and to the bench structure itself by a combination of the frame and arms to facilitate several different configurations for different exercises, i.e., parallel to the bench unit 40 and extending toward the seat.

The adjustable arms 48, for example may have multiple positions where the arm is rotated from 0 degrees, i.e., parallel to the bench unit 40 and extending toward the standing platform 50, to about 180 degrees, i.e., parallel to the bench unit 40 and extending toward the seat, along the support surface 58.

The portability and ease of storage of the bench units 40 also make this type of group program easily performed in an all purpose room. The bench units 40 can be easily moved by each participant at the beginning of class into the proper position. At the end of class, each participant can easily move their bench units 40 to a storage location, and tip them on their ends for compact storage, thus allowing the all purpose room to be used for other things, such as other exercise classes. The mobility of the bench units 40 also allow for different arrangements of the bench units 40 for class usage, depending upon the instructors desire, or the class content.

The use of the bench unit 40 also adds additional convenience because there is no special accessory equipment required, and no need to change weights or require a supply of weights for changing. Instead, the participant simply adjusts the pre-set load on the system to the desired level, swivels the arms into the proper position for the required exercise, and starts exercising. In addition, as a result of the variety of exercises and loads able to be utilized by the participant on the bench unit exercise device, the same equipment can be used from class to class for different purposes without requiring separating equipment or modifying equipment to any more extent than setting the pre-load level and the arm position on each bench. For instance, one class can be conditioning, one class can be strength and one class can be endurance one after the other without requiring any additional equipment modifications.

The group exercise program for use with the bench unit exercise devices keeps the participants motivated, the instructors motivated, and thus enhances the workout experience and financial gain of the club facilities.

Performance

During the performance of the exercise program, the instruction should focus on the proper set-up of the exercise equipment for the particular exercises to be performed, the desired resistance for the participants to be using, the technique to be used and the options for the participants to perform. The set-up of the exercise equipment, for example, may include the physical set-up of the exercise equipment, e.g., the correct bench and pulley arm positions for the exercise unit described above, and the body position on that exercise unit. The instruction should also include the resistance level that the participants should be using for a particular exercise. Although each participant may be using different resistance levels, the instruction can, at a minimum, give relative resistance levels between exercises being performed. An exercise focusing on a larger muscle group such as a squat, for example, will generally be performed with more resistance than an exercise focusing on a smaller muscle group such as a bicep curl.

In resistance training, the proper technique used in performing the exercises is critical both for the participants' safety and for their performance to continue to progress. The instruction should provide training including the technique required for proper execution of each exercise to be performed. If the participant is unable to correctly complete the expected number of repetitions for each exercise, the resistance can be lowered. Otherwise, the participant may risk injury or limit the effectiveness of the exercise by using an incorrect form or not performing the exercise over his or her full range of motion.

The instruction can also focus on stabilization during the performance of the exercises. "Stabilization," as used in this application, refers to actively engaging the muscles around a specific joint or an area of the body to control movement in that area. Stabilization establishes a base of support for that joint or area of the body during the performance of an exercise. For example, the torso, including the spine, shoulder girdle and pelvic area, can be considered the foundation of the body. Engaging the muscles around the joints in the torso to hold them in their natural and strongest position can strengthen that foundation. Depending upon the exercises performed, stabilization may be necessary in various joints throughout the body, sometimes many at the same time. Torso stabilization, for example, includes maintaining the integrity of the spine throughout movement of all parts of the body.

The program can also include various options that the participants may choose between. The program, for example, can provide a beginning, an intermediate and/or an advanced level exercise for focusing on a particular muscle group such as shown in Table 2.

TABLE 2

| | Basic | Intermediate | Advanced |
|---|---|---|---|
| Triceps | Seated Triceps Extension<br>Triceps Dips | Standing Triceps Extension<br>Triceps Kickback (bench support) | Lying Triceps Extension<br>Incline Triceps Extension |
| Biceps | Bicep Curl (face bench) | Bicep Curl (face away) | Lying Bicep Curl |
| Shoulders | Seated Overhead Press<br>Forward Raise (single handle)<br>Standing Shoulder Extension<br>Seated Upright Row | Upright Row<br>Kneeling Shoulder Extension | Lateral Raise |
| Abdominal Group | Torso Curl | Torso Curl (legs up) | Torso Curl with Leg Extension<br>Reverse Curl Variations |
| Lower Back | Lower Back Extension | Low Back Extension with Arms | |

Alternatively, the program may include differing options depending upon the participants' individual training goals. For example, the program may provide different options for focusing on strength, endurance or a combination of both strength and endurance such as described above.

The Program

Figure 5:
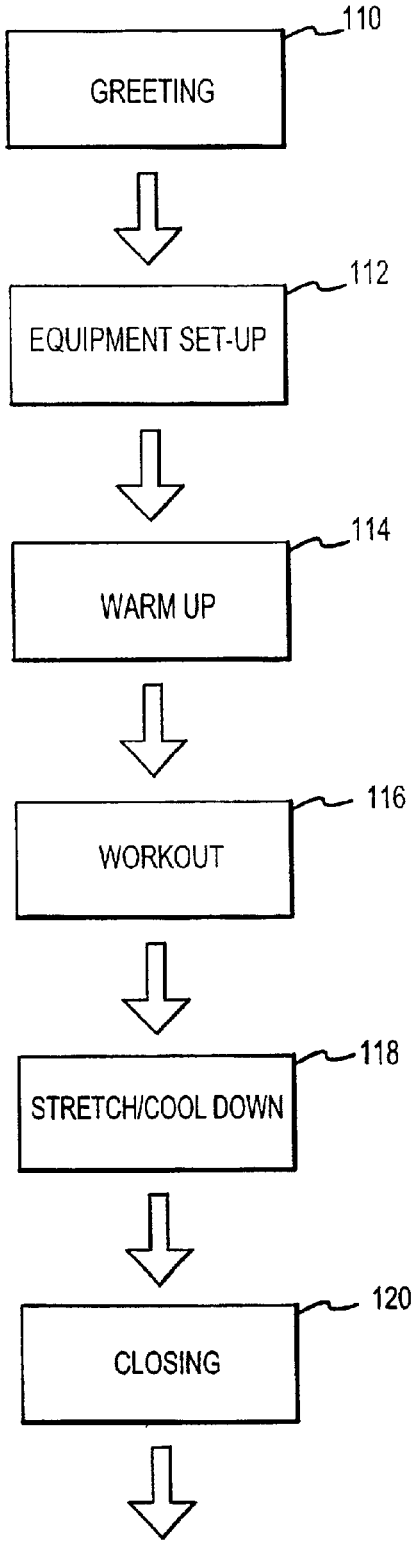
FIG. 5 is a flow diagram of an exemplary class sequence.

One possible class structure of a program is shown in FIG. 5. In this class, the instructor greets the participants in step 110. In this step, the instructor can introduce the program if necessary for new participants. For example, the instructor can introduce resistance training concepts such as the application of progressive resistance during exercise, stabilization, Natural Movement Training, etc. The instructor can also explain and/or demonstrate the proper operation of the exercise equipment and the proper performance of each exercise that the participants will be using during that particular class. Next, the participants can set up their exercise equipment so that it is ready for the first exercise such as shown in step 112. The instructor can also lead the class through a warm up routine before starting the actual workout program such as shown in step 114. The warm up can be a general warm up, such as jumping jacks, aerobic movements, squats, etc, to allow the participants to prepare both mentally and physically for the workout ahead. Preferably, the warm up should be about 5 minutes to about 7 minutes in maximum duration, and should involve the large muscle groups to elevate each of the participant's core temperature. Alternatively, or in addition, the warm up can be a more specific warm up tailored to the particular exercises the participants will be performing. A specific warm up is generally preferred because the muscles and joints can be warmed up with the mechanics that will be performed during the workout, the muscles and joints are less susceptible to injury, muscles can contract with greater intensity, and motor skills and breathing can be rehearsed before greater effort is given. Additional warm ups including extra repetitions or sets may be performed during the step 114 or during the actual workout in step 116 for muscles and/or joints that may be more susceptible to injury such as if squats or bench press exercises are to be performed. The warm up, however, should not compromise the intensity of the workout, and, if necessary, the participants may take a rest of about 30 seconds to about 4 minutes before beginning the workout sets.

During the workout, shown in step 116, the instructor can lead the participants through a series of exercises. Depending upon the participants' training goals, each exercise may include one or more sets, and each set may include one or more repetitions. In one embodiment, for example, an instructor may include three sets, including a warm up set and two workout sets, of an exercise such as a bench press. In the first set, i.e., the warm up set, the instructor may demonstrate the movement and warm up for the movement, announce the muscle or muscle groups it is targeting, ensure that all the participants have their equipment set up properly, and indicate to the participants approximately what resistance load they should be using. In the second and third sets, the instructor can leave his or her exercise equipment to assist the participants in changing the resistance load from the previous set in order to fatigue the muscle or muscle groups being used, correct the participants' technique including their body and equipment positioning, give the participants a rest such as an about 20 second to about 30 second rest in between sets, encourage simple stretches for the muscles being used, and give an indication to the participants if they should be adjusting the resistance load for the next set.

In step 118, the instructor can lead the group through a stretching and cool down routine using stretches to lengthen the muscles that were targeted during the workout including the assister and stabilizing muscles as well as the target muscles. The exercise equipment may also be used during the stretching and cool down routine 118. Preferably, the participants will stretch for at least about seven to about ten minutes.

In the closing step 120 the participants preferably return their exercise equipment to the starting position and wipe off their exercise equipment for the next group.

As discussed above, a program of the present invention may have many different designs that are tailored to the individual participants' fitness levels and training goals. For example, a possible structure of a foundation program is shown in Tables 3 and 4.

TABLE 3

| Basic | Intermediate | Advanced |
|---|---|---|
| Weeks 1–4 (1–2 classes per week) Introduction to Natural Movement Training | Weeks 4–6 (1–2 classes per week) Further Introduction to Natural Movement Training | Weeks 6 + (1–2 classes per week) All 5 of the most common Natural Movement Training movements included |
| Used as options in subsequent weeks and programs | Used as options in subsequent weeks and programs | Used as advanced options if needed for advanced participants |
| 8–10 movements in class | 10–12 movements in class | 12 + movements in class |
| 2–3 sets of each exercise | 2–3 sets of each exercise | 2–3 sets of each exercise |
| 12–15 repetitions per set | 12–15 repetitions per set | 12–15 repetitions per set |

TABLE 4

| | BASIC | INTER-MEDIATE | ADVANCED |
|---|---|---|---|
| Legs | Squats<br>Calf Raise<br>Squat to Calf Raise<br>Stationary Lunge | Reverse Lunges<br>Lunge with Leg Lift Variations | Leg Extension (lying & standing)<br>Leg Curl (lying, standing, kneeling)<br>Hip Extension (lying, standing, kneeling)<br>Abduction (lying, standing, sitting)<br>Adduction (lying, standing, sitting) |
| Chest | Incline Chest Press<br>Flat Chest Press<br>Pushups (on bench) | Flat Chest Press with torso curl<br>Flat Chest Press with Legs Up<br>Flat Bench Pullover<br>Incline Bench Pullover | Chest Press with Leg Extension<br>Chest Press with Torso Curl & Leg Extension<br>Pullover with Leg Extension |
| Back | Seated Scapular Retraction<br>Seated Horizontal Row | Scapular Retraction (spine)<br>Bent Over Row (spine) | Scapular Retraction (crank)<br>Bent Over Row (crank) |
| Triceps | Seated Triceps Extension<br>Triceps Dips (on bench) | Standing Triceps Extension<br>Triceps Kickback (bench support) | Lying Triceps Extension<br>Incline Triceps Extension |
| Biceps | Bicep Curl (face bench) | Bicep Curl (face away) | Lying Bicep Curl |
| Shoulders | Seated Overhead Press<br>Forward Raise (single handle)<br>Standing Shoulder Extension<br>Seated Upright Row | Upright Row (cross cable)<br>Kneeling Shoulder Extension | Lateral Raise |
| Abdominal Group | Torso Curl | Torso Curl (legs up) | Torso Curl with Leg Extension<br>Reverse Curl Variations |
| Lower Back | Lower Back Extension | Lower Back Extension with Arms | |

The foundation program shown in FIGS. 3 and 4 is designed to form a base fitness level on which more elaborate training may be built. The foundation program may be used as an introduction to resistance training while simultaneously challenging the participants' strength, endurance and stability. Natural Movement Training is preferably introduced in this program. The foundation program shown above, for example, includes traditional resistance training moves with a natural movement adaptation in at least 3 to 5 of the exercises. The exercises progress from large muscle groups to smaller muscle groups and include abdominal and lower back training.

The number of repetitions is preferably moderate such as about 12 to about 15 repetitions per set, and about 2 to about 3 sets of each exercise being performed with short rests in between. The first set generally serves as a warm up to address proper physical execution and assess resistance needs with regard to the exercise being performed. The second set gives the participant a chance to increase the resistance, if desired, and further perfect physical execution of the movement. The third set can be used to increase resistance again or to challenge the endurance of the particular muscle while keeping the resistance constant. Fatigue may lead to difficulty in stabilization, and the participant may elect to stretch the muscles instead of performing the third set if the muscle or muscle groups involved are overly fatigued. The first and third sets are optional.

The foundation program may remain fundamentally the same even when variations are introduced. For example, variations may simply involve the substitution or addition of exercises that increase or decrease the difficulty of training a particular body part. The foundation class shown in Tables 3 and 4 is divided into three categories: basic movements, intermediate movements, and advanced movements. Combined, the moves can formulate a solid resistance training foundation. Taking into consideration the experience level of the instructor and the participants, the different levels of movement can be given as options as one exercise builds on another. The basic movements are used as the core of the foundation program shown above for the first four weeks. The intermediate movements focus on the same major muscle groups that are targeted by the basic movements but may increase in difficulty due to an increased lever length or stabilization adaptations, for example. In the foundation program shown above, the intermediate movements are introduced during weeks four to six with the basic movements being given as options. Although the same muscle groups are being challenged with the new exercises, the amount of resistance necessary to create overload may be different due to the mechanics of the new exercises. The participants preferably use lower resistance for the first set of each exercise to assess the difficulty of a new movement. The intermediate movements can continue to be used throughout the resistance training program and can be further developed in the advance movements and subsequent training. The advance movements are introduced after week six or beyond in the foundation program shown in Tables 3 and 4. The advanced movements further intensify the basic movements and require additional core stabilization techniques. A base level of resistance and fitness are preferably achieved before the advanced movements are attempted. Advanced movements can be introduced intermittently while maintaining a majority of basic and intermediate movements. Basic and intermediate movements can also continue to be given as options for the participants.

An alternative exemplary total body conditioning program format is shown in Table 5.

TABLE 5

| Total Body Conditioning Conditioning/Basic Exercise Sequence | |
|---|---|
| 1. | Flat Bench Chest Flys |
| 2. | Squats - feet parallel |
| 3. | Standing Upper Back Row |
| 4. | Step-Ups on Bench |
| 5. | Repeat #1–4 |
| 6. | Incline Bench Press |
| 7. | Plie's |
| 8. | Single Arm Rows |
| 9. | Dead Lifts on bench-Hamstrings |
| 10. | Repeat #6–9 |
| 11. | Seated overhead press-shoulders |
| 12. | Standing Abduction-medial glutes |

TABLE 5-continued

| Total Body Conditioning Conditioning/Basic Exercise Sequence | |
|---|---|
| 13. | Standing Lateral Raises-medial delts |
| 14. | Calve Raises |
| 15. | Repeat #11–14 |
| 16. | Seated Overhead Tricep extensions |
| 17. | Seated Bicep curls |
| 18. | Repeat #16–17 |

Table 5 shows a sequence of exercises that may be performed in an exemplary total body conditioning workout class.

Table 6 shows various upper and lower body exercises that may be performed during a class.

TABLE 6

| EXERCISE MENU | |
|---|---|
| Upper Body | Chest Fly - Flat/Incline Decline |
| | Chest Press - Flat/Incline/Decline |
| | Push-Ups |
| | Decline Push-Ups - (feet on bench) |
| | Cable Cross Over - seated/standing |
| | Upper Back Row - seated/standing |
| | Single Arm Row |
| | Bent Over Row |
| | Overhead Press - seated/standing |
| | Lateral Raise - seated/standing |
| | Front Raise - seated/standing |
| | Pullovers |
| | Shoulder Re-hab - various moves |
| | Shrugs |
| | Upright Row - Various grips |
| | Tricep Extension - seated/standing |
| | Over-head or Behind back - (elbow close) |
| | Dips on bench - all angles |
| | Tricep push-ups |
| | Bicep curls - all angles-incline too |
| Lower Body | Step-ups |
| | Hamstring Curls-standing/kneeling on bench-singles |
| | Gluteal Work-kneeling on bench |
| | Dead lifts on bench |
| | Abduction/Adduction-standing or laying on side on bench |
| | Squats w/bar in between handles-all feet positions |
| | Leg Press-seated on bench press out |
| | Plyometric options for circuit formats-utilize bench |

Table 7 shows various exercises that may be performed to target specific muscle groups in the body during a class.

TABLE 7

| EXERCISES FOR VARIOUS BODY PARTS | |
|---|---|
| Chest | Flat chest press |
| | Flat chest Fly |
| | Incline chest press |
| | Incline chest fly |
| | (single arm both of these groups of exercises) |
| Back | Flat lat pull-down |
| | Single arm lat pull-down |
| | Seated row |
| | Standing row |
| | Bent-over single arm row |
| | Back extensions |
| | Supine pullover |
| | Prone rear delt fly |
| Shoulders | Overhead press (single or double arm) |
| | Side raise (single or double arm) |
| | Front raise (single or double arm) |
| | Shrugs |
| | High pull |

TABLE 7-continued

| EXERCISES FOR VARIOUS BODY PARTS | |
|---|---|
| Triceps | Overhead extensions (single or double) |
| | Nose breakers |
| | Kickbacks |
| Biceps | Standing curls (single, double or alternating arms) |
| | Preacher curls offside of bench |
| | Incline curls |
| | Concentration curls |
| Legs | Back squats/Front Squats |
| | Lunge squats |
| | Standing hamstring curls |
| | Adduction/Abduction (seated and standing) |
| | Calf raises (seated and standing) |
| | Kickbacks for glute |

TABLE 8

| | |
|---|---|
| A. | Chest Fly-Flat/InclineDecline |
| | Chest Press-Fflat/Incline/Decline |
| | Push-ups |
| | Decline Push-ups |
| | Cable Cross Over-Seated/Standing |
| B. | Step-ups on bench-alternate legs |
| | Hamstring Curls-Standing/kneeling on bench |
| | Gluteal work-kneeling on bench |
| | Dead Lifts on bench |
| | Abduction/Adduction-Standing or laying on side on bench |
| | Squats w/bar in between handles-all positions |
| | Leg Press-seated on bench press out |
| C. | Upper Back Row-Seated/Standing |
| | Single Arm Row |
| | Bent Over Row |
| | Overhead Press-Seated/Standing |
| | Lateral Raise-Seated/Standing |
| | Front Raise-Seated/Standing |
| | Pullovers-Supine on bench |
| | Shoulder re-hab-various moves |
| | Shrugs |
| | Upright Row-various grips |
| | Tricep Extension-Seated/Standing Overhead or Behind Back |
| | Dips on bench-all angles |
| | Tricep push-ups |
| | Bicep curls-all angles-incline too |

Table 8 Shows groups of exercises that may be used during a workout. For example, our workout may include the following from Table 8.

Total Body Conditioning

1. Basic Warm up
2. Choose 2 exercises from Box A
3. Choose 4 exercises from Box B
4. Choose 2 exercises from Box C
5. Cool Down and Stretch Tables 9–13 show various exemplary workout exercise sequences that may be performed during a class.

TABLE 9

| CHEST, LEGS ARMS AND ABDOMINALS (Super set each exercise) | |
|---|---|
| 1. | Warm up (5 minutes) |
| 2. | Incline Bench-Upper Chest Press (3 sets 12×) |
| | Plies (20×) |
| 3. | Decline Push ups (feet on bench) (2 sets) |
| | Squats (20×) |
| 4. | Incline Chest Flys (3 sets 12×) |
| | Modified Lunges (20×) |

TABLE 9-continued

| CHEST, LEGS ARMS AND ABDOMINALS (Super set each exercise) | |
|---|---|
| 5. | Flat Bench Press (3 sets 12×) |
| | Standing Hamstring Curls (20×) |
| 6. | Seated Tricep extensions overhead (3 sets 12×) |
| | Seated Bicep curls (3 sets 12×) |
| 7. | Ab series on bench and floor |
| 8. | Stretch and cool-down on floor |

TABLE 10

| BACK, LEGS, ARMS AND ABDOMINALS (Super set each exercise) | |
|---|---|
| 1. | Warm up (5 minutes) |
| 2. | Standing Low Row (lats) (3 sets 12×) |
| | Standing Leg Extension to the back-Glutes (20×) |
| 3. | Standing Upper Back rows (3 sets 12×) |
| | Front Squats (20×) |
| 4. | One Arm Rows (3 sets 12×) |
| | Standing Hamstring Curl (20×) |
| 5. | Standing Reverse Pullover (3 sets 12×) |
| | Stiff legged Dead Lifts (30×) |
| 6. | Standing Tricep Overhead Extension (3 sets 12×) |
| | Incline Bench Bicep curls (3 sets 12×) |
| 7. | Ab Series |
| | Puch ups |
| 8. | Stretch and cool-down |

TABLE 11

| SHOULDERS, LEGS, ARMS AND ABDOMINALS | |
|---|---|
| 1. | Warm up (5 minutes) |
| 2. | Seated Overhead Shoulder Press (3 sets 12×) |
| 3. | Standing Leg abduction (20×) |
| 4. | Standing Lateral Raises (3 sets 12×) |
| 5. | Standing Leg adduction (20×) |
| 6. | Standing Upright Rows (3 sets 12×) |
| 7. | Straight leg dead lifts (20×) |
| 8. | 45° Angle Lateral Raises (3 sets 12×) |
| 9. | Modified Lunges (20×) |
| 10. | Shoulder Shrugs (3 sets 12×) |
| 11. | Standing Leg Extension (20×) |
| 12. | Seated Tricep Kick backs (3 sets 12×) |
| 13. | Standing Preacher Curls (3 sets 12×) |
| 14. | Ab series |
| 15. | Stretch and cool-down |

TABLE 12

| AB SERIES/STRETCH | |
|---|---|
| 1. | Warm up |
| 2. | Squats |
| 3. | Modified Lunges |
| 4. | Hamstring Curls |
| 5. | Standing Squat |
| 6. | Front Squat |
| 7. | Standing on bench |
| 8. | Dead lifts-hamstring |
| 9. | Standing Rows |
| 10. | Flat bench pullovers |
| 11. | Standing upright rows |
| 12. | Kneeling-one knee on bench-single arm dumbbell row |
| 13. | Chest |
| 14. | Flat bench press |
| 15. | Incline Bench-Press and Flys |
| 16. | Chest |
| 17. | Flat Bench Flys |
| 18. | Seated overhead press-Shoulders |

TABLE 12-continued

| AB SERIES/STRETCH |
|---|
| 19. Lateral Raises |
| 20. Rear delts |
| 21. Tricep extension |
| 22. Abs series/stretch |

TABLE 13

| |
|---|
| 1. Warm up |
| 2. Squats (20×) |
| 3. Pullovers (15×) |
| 4. Modified Lunges - R leg front (20×) |
| 5. Seated Overhead Press (15×) |
| 6. Modified Lunges - L leg front (20×) |
| 7. Flat Bench Press - Chest Press (Place in arm position 2) |
| 8. Take Right arm to position 3<br>Bring cable under bench - Standing Glute Squeeze Right Leg Back to position 2 (arms)<br>Chest Press |
| 9. Place left arm in position 3 - bring cable under - Standing glute squeeze left leg |
| 10. Incline Bench-Chest Flys |
| 11. Adjust Resistance-Place Arms in Position 1<br>Front Squats - (Cross Arms in front) |
| 12. Standing Rows - (face bench) |
| 13. Standing front raises - (face bench) |
| 14. Keep same resistance go to position 4<br>Seated lateral raises (same resistance) |
| 15. Seated rear delts |
| 16. Adjust resistance - go to arm position 1<br>Seated tricep extension overhead (facing back) |
| 17. Seated bicep curls |
| 18. Seated Tricep kick backs |
| 19. Bicep-Hammer curl |

Tables 14–17 show various exercises that may be included in a workout listed by the arm position and bench position of the adjustable-load multi-position bench unit 40 shown in FIG. 4 and described above.

TABLE 14

EXERCISE BY EXERCISE UNIT POSITION

| Arm Position | Bench Position | Exercise |
|---|---|---|
| 1. 0° - Position 1 | Flat Bench | Chest Press<br>Pullover<br>Tri-Cep Extension<br>Prone-Tri Cep Kick Back<br>Prone-shoulder series-(rehab/swim exercises)<br>Rear Delt<br>Standing upper back row<br>Standing rear delt<br>Standing on bench dead lift-hamstrings<br>Adduction<br>Abduction<br>Side lateral raise-single arm<br>Front Squats-with bar<br>Shoulder Shrugs<br>Upright row<br>Front raise<br>Standing Bi-cep curl/Tri-cep extension |
| 2. 45° - Position 2 | Incline Bench | Chest Press |
| 3. 90° - Position 3 | Flat Bench | Chest Flys<br>Internal/External Rotation<br>Take pully under bench-stand facing bench (All Uni-lateral)<br>Standing Hamstring curl<br>Abduction |

TABLE 14-continued

EXERCISE BY EXERCISE UNIT POSITION

| Arm Position | Bench Position | Exercise |
|---|---|---|
| | | Adduction<br>Standing Straight leg extension-Glute<br>Standing leg extension-Quads/Stabilization |
| 4. 120° - Position 4 | 90° Bench | Seated over head press<br>Bi-Cep Curl-(short range of motion)<br>Lateral Raise with elbows bent-(Shorten lever)<br>Rotator Cuff Extension - elbows close/(Bi-cep tendon external rotation) |

TABLE 15

| Arm Position | Bench Position | Exercise |
|---|---|---|
| Zero Degrees | Flat | Squats |
| Zero Degrees | Flat | Standing Low Row |
| Zero Degrees | Flat | Lunge-R/L |
| Zero Degrees | Flat | Pullovers |
| Zero Degrees | Flat | Squats |
| Zero Degrees | Flat | Standing Low Row |
| Zero Degrees | Flat | Lunge-R/L |
| Zero Degrees | Flat | Pullovers |
| Forty Five Degrees | Flat | Chest Press |
| Forty Five Degrees | Flat | Hamstring Curl-R/L |
| Forty Five Degrees | Incline | Chest Fly |
| Forty Five Degrees | Incline | Standing Leg Ext. |
| Forty Five Degrees | Flat | Chest Press |
| Forty Five Degrees | Flat | Hamstring Curl |
| Forty Five Degrees | Incline | Chest Fly |
| Forty Five Degrees | Incline | Standing Leg Ext. |
| Ninety Degrees | Flat | Chest Fly |
| Ninety Degrees | Flat | Seated military press |
| Ninety Degrees | Flat | Lateral Raises |
| Ninety Degrees | Flat | Seated military press |
| Ninety Degrees | Flat | Lateral Raises |
| Ninety Degrees | Flat | Rear Delts |
| Ninety Degrees | Flat | Front Raises/Anterior |
| Ninety Degrees | Flat | Shoulder Shrugs |
| Ninety Degrees | Flat | Tricep Ext. |
| Ninety Degrees | Flat | Bicep Curls |
| Ninety Degrees | Flat | French Press-Tricep |
| Ninety Degrees | Incline | Bicep Curls |

TABLE 16

| Arm Position | Bench Position | Exercise |
|---|---|---|
| Zero Degrees | Flat | Squats |
| Zero Degrees | Flat | Standing Row |
| Zero Degrees | Flat | Lunge R/L |
| Zero Degrees | Flat | Pullovers |
| Zero Degrees | Flat | Single Arm Row |
| Zero Degrees | Flat | Glute Squeeze |
| Forty Five Degrees | Flat | Chest Press |
| Forty Five Degrees | Incline | Chest Fly |
| Forty Five Degrees | Incline | Leg Abd. R/L |
| Ninety Degrees | Flat | Chest Fly |
| Ninety Degrees | Flat | Military Press |
| Ninety Degrees | Flat | Lateral Raise |
| Ninety Degrees | Flat | Anterior Delt |
| Ninety Degrees | Flat | Tricep Ext. |
| Ninety Degrees | Flat | Bicep Curls |

TABLE 17

| Arm Position | Bench Position | Exercise |
|---|---|---|
| Zero Degrees | Flat | Squats |
| Zero Degrees | Flat | Standing Row |
| Zero Degrees | Flat | Lunge R/L |
| Zero Degrees | Flat | Pullovrs |
| Zero Degrees | Flat | Single Arm Row |
| Zero Degrees | Flat | Glute Squeeze |
| Forty Five Degrees | Flat | Chest Press |
| Forty Five Degrees | Incline | Chest Fly |
| Forty Five Degrees | Incline | Leg Abd. R/L |
| Ninety Degrees | Flat | Chest Fly |
| Ninety Degrees | Flat | Military Press |
| Ninety Degrees | Flat | Lateral Raise |
| Ninety Degrees | Flat | Anterior Delt |
| Ninety Degrees | Flat | Tricep Ext. |
| Ninety Degrees | Flat | Bicep Cursl |

TABLE 18

| General Conditioning | Strength Conditioning | Endurance Conditioning |
|---|---|---|
| Flat Chest Fly | Hamstring Curl | Incline Chest Fly |
| Standing Row | Front Squats | Flat Bench |
| Incline Chest Press | Standing Calf raise | Supine Pullover |
| Prone Rear Delt fly | Lunges | Single Arm Bent Over Rows |
| Seated Overhead Press | Flat Bench Press | |
| Tricep Kickbacks | Seated Rows | Single Arm Lateral Raises |
| Standing Single Arm Side Raise | Seated Overhead Press | High Pulls |
| Bicep Curls | Standing Bicep Curls | Tricep Kickbacks |
| | Supine Tricep Extensions | Dips |
| Standing Hamstring Curls | Core | Alternating Bicep Curls |
| Front Squats | | Incline Bicep Curls |
| Standing Knee Extensions | | Knee Extensions |
| Lunges | | Hamstring Curls |
| Abjuction & Adduction | | Front Squats |
| Calf Raises Core | | Ab & Add |
| | | Calf raises |
| | | Core |

The general conditioning class can be a foundation class to prepare participants for more advanced classes or can be used as an every other day class for general training. The class uses high numbers of repetitions and light to moderate weight in order to promote muscle memory and movement pattern adaptation. For example, the general conditioning class may include:

2–3 exercises per body part (single arm or leg movements are acceptable) exercises can be performed in any order or sequence 2–3 sets per exercise 15–20 repetitions per set 60 second rest 40% to 60% of maximum weight for 1 repetition and exercise movement The strength condition class can build upon the general conditioning class. The strength conditioning class will train the central nervous system to recruit high numbers of muscle fibers. More major muscle group exercises are performed with a focus on multiple joint exercises than assisting muscle group exercises. For example, the strength conditioning class may include:

1–2 exercises per body part (no single arm or leg movements)

3–5 sets per exercise

4–8 repetitions per set

2+ minute rest

85% to 95% of maximum weight for 1 repetition of exercise movement

Exercises can be performed in different orders from push to pull or switching upper and lower body exercises.

The endurance conditioning class can also build upon the general conditioning class. The endurance conditioning class will extend the participants' ability to manage fatigue at high load levels by increasing capillary density and the number and size of mitochondria energy producing sites within the muscle. For example, the endurance conditioning class may include:

2–3 exercises per body part (single arm or leg movements are acceptable)

3–4 sets per exercise

20–30 repetitions per set 30 second rest

30% to 50% of maximum weight for 1 repetition of exercise movement

Exercise can be performed in any order or sequence

Circuit training would be normal for this class.

Circuit Training

As an alternative to a program using individually assigned exercise units that are changed to accommodate different exercises, individual exercise units can be set up in a "circuit" for each of the different exercises to be performed. These exercise units may be arranged in generally in a circle, oval, row or some other arrangement in which the participants may move from machine to machine while performing an exercise at each exercise units. If fewer exercise units are available than the number of exercises to be performed, however, one or more of the exercise units may be used for more than one of the exercises to be performed. Preferably, the same types of resistance training exercises as described above, such as the Natural Movement Training, are used. For example, the circuit training exercise sequencing can be the same or similar to the exercise sequence in the foundation program described above except that the starting point for each participant depends upon where in the sequence he or she starts. All or a portion of the major muscle groups can be targeted. The resistance levels for the circuit training are generally less than in a standard resistance training program because endurance is usually the focus rather than strength. In the circuit training format, up to two participants per piece of exercise equipment can participate in a particular class in which one participant is resting, stretching or performing some other exercise while another participant is performing one of the exercises on the exercise equipment.

The circuit training format furthers the participants' familiarity with traditional resistance training while simultaneously challenging muscular endurance and stability. Generally, a participant performs more repetitions than in a standard resistance training format, but it is up to the participant to determine how many repetitions to perform. Each "set" may be timed such that when the time is up, the set is over and the participant moves on to the next station. Preferably, the time for a particular set can vary between about one minute and about three minutes. The number of sets the participant will perform for each specific exercise depends upon the number of times the circuit is completed in a particular class. Preferably, each participant rotates through the circuit from about one to about three times. In this embodiment, the first time through the circuit can be used as a resistance training specific warm up to address proper physical execution and to assess resistance needs for each exercise. The second time through the circuit can give the participants a chance to increase the resistance, if they desire, and to further perfect their physical execution of the movements. The third time through the circuit can be used to increase resistance again or to challenge the endurance of the particular muscle or muscle group while keeping the level of resistance constant. Again, fatigue can increase the difficulty in stabilization and a participant can elect to stretch a particular muscle or muscle group instead of performing the third set if the muscle or muscle group is particularly fatigued.

The circuit training format can also include further variations. For example, aerobic and/or rest intervals can be included between two or more of the resistance training exercises. An aerobic interval, for example, can be used to add a cardiovascular component to the workout. Aerobic conditioning may include, but is not limited to: jogging in place, plyometrics, using step benches for combinations or simply stepping up and down, jumping rope, relays or rebounders. The aerobic intervals can stay the same or change between every station. Depending upon the focus for the program, the aerobic conditioning interval can last as long as the resistance training segment, or it can be shorter or longer. Adding rest intervals allows the participants to rest between resistance exercises. Again, the rest intervals can be the same, shorter or longer than the resistance training segment depending upon the fitness level of the participants and the focus of the program. During rest periods, the participants can engage in light stretching and mobility exercises to stay warm and ready their body for the next session. The resting person can also serve as a motivator for the person performing the resistance training exercise.

Organization

Figure 6:
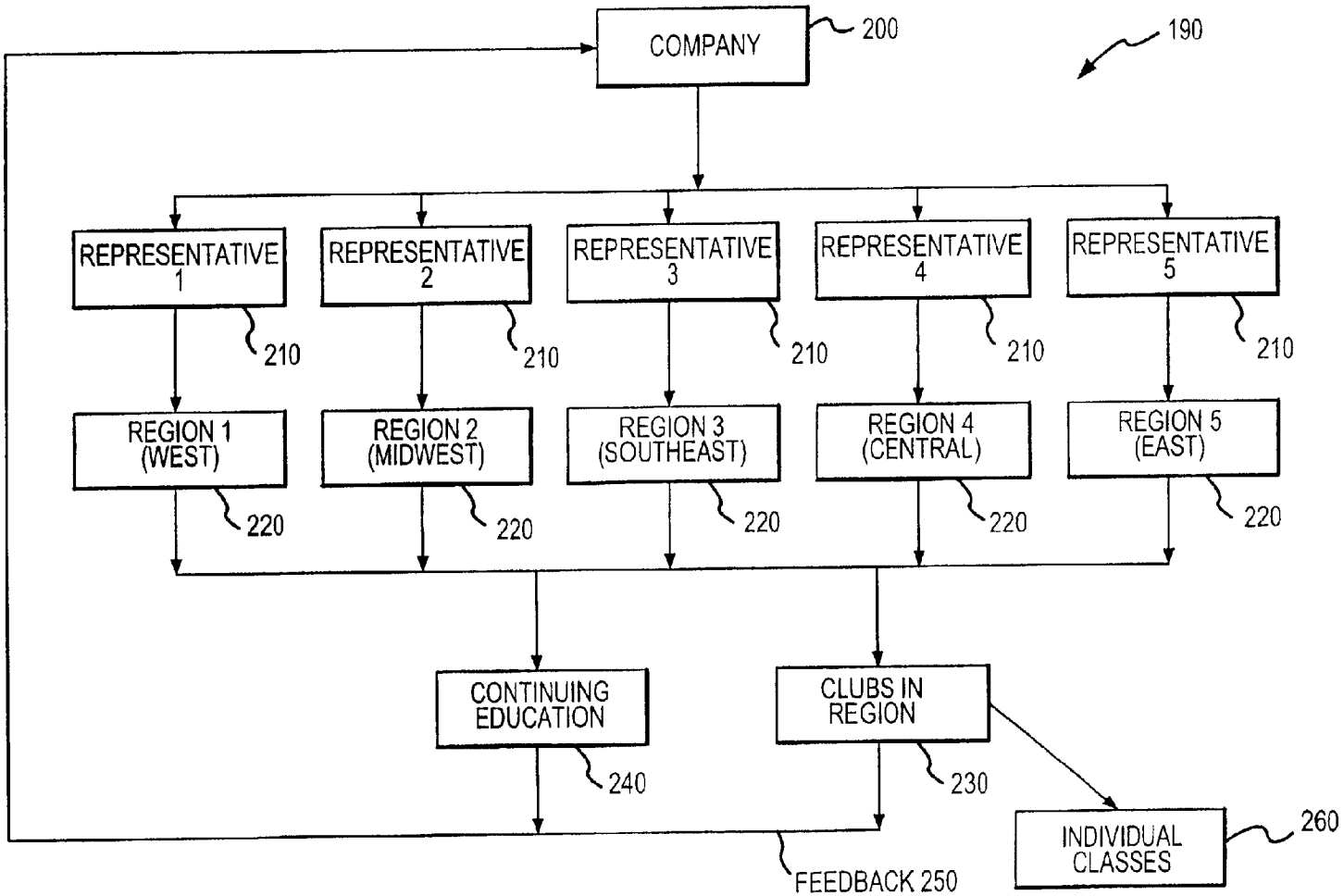
FIG. 6 is a block diagram of an exemplary organization that may be used to implement the program of the present invention.

FIG. 6 shows an organization 190 for implementing the program of the present invention. In this organization 190, the company 200 specifically organizes and trains a group of representatives 210 in the program of the present invention including, but not limited to, resistance training fundamentals; class and program planning, organization and execution; proper and safe use of the one or more exercise units to be used during the classes of the program; and training skills and certification requirements for individual instructors in the program.

Each of the representatives 210 is responsible for training and certifying individual instructors within that representative's region. The representatives' regions may be divided among different geographic regions 220 such as shown in FIG. 6, or may be divided by other qualifications such as demographics or market size. The representatives 210 may train and certify the individual instructors at the individual clubs 230 within that representatives region, or may hold training and certification classes at other locations where a larger number of instructors may be able to be trained together. For example, if a particular club has five or more instructors the representative 210 may perform the training at the club, while if a particular club only has one or two instructors to be trained, it may be more efficient for the representative 210 to combine the training and certification process with other instructors in the area. The company 200 may sell packages including the certification of a predetermined number of instructors along with the exercise units, or may sell exercise units separately from the training and certification to the individual clubs.

The representatives 210 are also responsible for continuing education 240 of the certified instructors in the representatives' individual regions. The continuing education may include periodic training and workshops for the certified instructors at the individual clubs, instructor conventions and conferences, and off-site training facilities. The continuing education training and workshops, for example may include more advanced instruction skills, new class formats, new resistance exercise training techniques, and other methods to keep the program fresh and exciting to the participants. The representatives 210 and/or the company 200 can publish periodic newsletters with course design suggestions, calendars of upcoming events, new accessories, etc.

The representatives 210 also play the role of a market tester by being sensitive to the individual needs and desired changes of the individual clubs and instructors within the representatives' individual regions. The representatives receive feedback 250 from their certification training, continuing education courses and/or personal visits to the clubs to observe the program classes 260 and organization at the club level, and communicate this information back to the company 200 for the continuous improvement of the company's products and services. Thus, the overall system of coordinating the group exercise program is continuously refined and improved based on the feedback from the clubs and instructors as well as the individual participants.

The company 200 selects the representatives 210 based on their abilities to teach, train and sell the program to the clubs. For example, the representatives 210 preferably are certified through ACE, AFAA, ACSM or a University equivalent, are an energetic, dynamic leader in the fitness industry, have a positive self-esteem with a strong work ethic, are dedicated to being the best, are assertive, goal-oriented, convincing individuals who are pro-active in closing a deal, team players who others enjoy and want to work with, are creative, innovative fitness professionals who can arrange events to be successful, have effective organizational skills, and have the ability to travel.

The emphasis of the organization of the group exercise program is to enhance the experience of the certified instructors teaching the program in the individual clubs, as well as providing individual training with emphasis on proper form and technique to the individual participants. By certifying individual instructors in the program, the company 200 can ensure that the participants in each of the participating clubs receive the proper instruction and safety as well as the enjoyment that comes from participating in a well organized class. Minimum certification requirements are preferably required across each of the regions. Minimum certification requirements, for example, may include preparing by reading and understanding preparation materials including required background information, participating in a full day, 8-hour training course and passing a written and practical certification test. The training course, for example, may include training on the exercise unit to be used in the programs the particular instructor will be teaching, team building drills and exercises, preparation of individual classes and entire programs, understanding the benefits of resistance training, safety, instructional techniques, basic resistance training movements and terminology, class organization, music suggestions, sequencing of exercises within individual classes and programs, and how to execute a resistance test/load evaluation.

The organization provides a turn key program for club owners that may design their own variations of group exercise programs in order to distinguish themselves from other clubs. For example, a particular club may offer resistance training exercise programs designed for all fitness levels such as foundation programs, full-body conditioning programs, strength-specific programs, endurance-specific programs, balance and stability specific programs as well as individual sport-specific exercise programs that utilize particular exercises to enhance a participants performance in one or more specific sports. The programs can focus on individualized attention, and proper form and technique.

While the invention has been described in conjunction with the specific embodiments outlined above, it is evident that many alternatives, modifications, and variations will be apparent to those skilled in the art. Accordingly, the preferred embodiments of the invention are intended to be illustrative and not limiting. Various changes may be made without departing from the spirit and scope of the invention as defined in the following claims.

What is claimed is:

1. A group program for resistance exercise training for at least a first user and a second user comprising the steps of:

(a) providing at least a first and a second convertible multi-position exercise unit adapted for use by the at least first user and the second user, respectively, each of said exercise units being convertible to several different configurations to allow the users to perform multiple different exercises on said exercise units in a generally coordinated manner at the direction of an instructor, each of said exercise units further including:

(i) a frame, (ii) a seat positioned on said frame, and (iii) an adjustable resistance engine attached to said frame;

(b) providing instruction in operating said exercise units for performing a first resistance training exercise in a first configuration;

(c) providing instruction in converting said exercise units from said first position to a second configuration; and (d) providing instruction in operating said exercise units for performing a second resistance training exercise in said second configuration.

2. The group program of claim 1, wherein said plurality of exercise units are arranged in one of the group selected from: a circle, an oval, a row, a triangle and a square.

3. The group program of claim 1, wherein said plurality of exercise units are positioned facing a common location to be used for instruction.

4. The group program of claim 3, wherein the common location is to be used by an instructor.

5. The group program of claim 3, wherein a convertible multi-position exercise is located at said common location for demonstration of said first resistance training exercise by an instructor.

6. The group program of claim 1, wherein said step of providing instruction in converting said exercise units further includes providing instruction in changing a resistance of said adjustable resistance engine.

7. The group program of claim 1, further comprising the step of providing one of the group selected from: background music and music choreographed to said first and second resistance training exercises.

8. The group program of claim 1, wherein said first resistance training exercise includes a positive contraction of a target muscle and a negative contraction of an antagonist muscle.

9. The group program of claim 1, wherein said first resistance training exercise includes contraction of one or more of the group selected from: a stabilizer muscle, a dynamic stabilizer muscle, and an antagonist stabilizer muscle.

10. The group program of claim 1, wherein said group program includes a first class and a second class that vary in one or more of the group selected from: exercises, exercise sequences, durations, intensities, resistance progressions, speeds, ranges and frequencies.

11. The group program of claim 10, wherein said variations are designed to achieve different fitness goals.

12. The group program of claim 11, wherein said different fitness goals include one or more of the group selected from: a general conditioning goal, a strength goal, an endurance goal, and a power goal.

13. The group program of claim 1, wherein said group program includes a class, said class including a sequence of resistance training exercises at least one of which includes a plurality of options that may be performed.

14. A group program for resistance exercise training for at least a first user and a second user comprising the steps of:

(a) providing at least a first and a second convertible multi-position exercise unit adapted for use by the at least first user and the second user, respectively, each of said exercise units being convertible to several different configurations to allow the user to perform multiple different exercises on said exercise units in a generally coordinated manner at the direction of an instructor, each of said exercise units further including:

(i) a frame, (ii) a seat positioned on said frame, and (iii) an adjustable resistance engine attached to said frame;

(b) operating said plurality exercise units to perform a first resistance training exercise in a first configuration of said exercise units;

(c) converting said plurality of exercise units from said first configuration to a second configuration; and (d) operating said exercise units for performing a second resistance training exercise in said second configuration.

15. The group program of claim 14, wherein said plurality of exercise units are arranged in one or more of the group selected from: a circle, an oval, a row, a triangle and a square.

16. The group program of claim 14, wherein said plurality of exercise units are positioned facing a common location to be used for instruction.

17. The group program of claim 16, wherein the common location is to be used by an instructor.

18. The group program of claim 16, wherein a convertible multi-position exercise is located at said common location for demonstration of said first resistance training exercise by an instructor.

19. The group program of claim 14, wherein said step of converting said exercise units further includes changing a resistance of said adjustable resistance engine.

20. The group program of claim 14, further comprising the step of providing one of the group selected from: background music and music choreographed to said first and second resistance training exercises.

21. The group program of claim 14, wherein said first resistance training exercise includes a positive contraction of a target muscle and a negative contraction of an antagonist muscle.

22. The group program of claim 14, wherein said first resistance training exercise includes contraction of one or more of the group selected from: a stabilizer muscle, a dynamic stabilizer muscle, and an antagonist stabilizer muscle.

23. The group program of claim 14, wherein said group program includes a first class and a second class that vary in one or more of the group selected from: exercises, exercise sequences, durations, intensities, resistance progressions, speeds, ranges and frequencies.

24. The group program of claim 23, wherein said variations are designed to achieve different fitness goals.

25. The group program of claim 24, wherein said different fitness goals include one or more of the group selected from: a general conditioning goal, a strength goal, an endurance goal, and a power goal.

26. The group program of claim 25, wherein said group program includes a class, said class including a sequence of resistance training exercises at least one of which includes a plurality of options that may be performed.

27. The group program of claim 14, wherein said exercise unit is portable.

28. The group program of claim 14, wherein said adjustable resistance engine has a weight, said adjustable resistance engine is adapted to create a resistance greater than said weight of said adjustable resistance engine.

29. The group program of claim 14, wherein said adjustable resistance engine is below a plane of said seat.

30. A method for implementing a group program for resistance exercise training comprising the steps of (a) providing training for the group program for one or more representatives each having an area of responsibility;

(b) providing training for a plurality of individual instructors for the planning and administering individual sessions of the group program via said representatives;

(c) certifying said plurality of individual instructors have successfully completed said training; and (d) planning and implementing a group resistance training program using a plurality of convertible multi-position exercise units, each of said exercise units being convertible to several different configurations to allow a user to perform multiple different exercises on said exercise units, said exercise units including a frame, a seat positioned on said frame and an adjustable resistance engine attached to said frame.

31. The method for implementing a group program of claim 30, further comprising the step of providing feedback from said instructors to said representatives.

32. The method for implementing a group program of claim 30, wherein said training steps includes operation and conversion of said exercise units.

33. The method for implementing a group program of claim 30, wherein said resistance training program provides a circuit resistance training program including said plurality of exercise units being configured in at least two different configurations.

34. The method of claim 1 wherein the adjustable resistance engine attached to said frame further comprises elastomer springs; and and actuator attached to said resistance engine wherein said resistance engine provides a constant load to the user when said actuator is actuated.

35. The method of claim 14 wherein the adjustable resistance engine attached to said frame further comprises elastomer springs; and and actuator attached to said resistance engine wherein said resistance engine provides a constant load to the user when said actuator is actuated.

* * * * *

UNITED STATES PATENT AND TRADEMARK OFFICE

CERTIFICATE OF CORRECTION

PATENT NO. : 7,189,190 B2
APPLICATION NO. : 09/805067
DATED : March 13, 2007
INVENTOR(S) : Kevin Lamar et al.

It is certified that error appears in the above-identified patent and that said Letters Patent is hereby corrected as shown below:

Title Page Item (56), References Cited, U.S. PATENT DOCUMENTS, page 2, delete

"5,495,799A" 03/1996 Daniel"

and insert:

--5,435,799 A 07/1995 Lundin--.

Column 26, line 21, delete "user" and insert --users--.

Signed and Sealed this

Fifteenth Day of May, 2007

JON W. DUDAS
*Director of the United States Patent and Trademark Office*